US005770352A

United States Patent [19]

Chari

[11] Patent Number: 5,770,352

[45] Date of Patent: Jun. 23, 1998

[54] HIGH ACTIVITY PHOTOGRAPHIC DISPERSIONS WITH ULTRA LOW LEVELS OF PERMANENT SOLVENT

[75] Inventor: Krishnan Chari, Fairport, N.Y.

[73] Assignee: Eastman Kodak Company, Rochester, N.Y.

[21] Appl. No.: 634,491

[22] Filed: Apr. 18, 1996

[51] Int. Cl.[6] ..... G03C 7/25

[52] U.S. Cl. ..... 430/546; 430/631; 430/935

[58] Field of Search ..... 430/546, 631, 430/935

[56] References Cited

U.S. PATENT DOCUMENTS

| | | | |
|---|---|---|---|
| 2,322,027 | 6/1943 | Jelley et al. | 430/546 |
| 2,787,544 | 4/1957 | Godowsky et al. | 430/545 |
| 2,801,170 | 7/1957 | Vittum et al. | 430/545 |
| 2,870,012 | 1/1959 | Godowsky et al. | 430/546 |
| 4,199,363 | 4/1980 | Chen | 430/512 |
| 4,388,403 | 6/1983 | Helling et al. | 430/546 |
| 4,957,857 | 9/1990 | Chari | 430/546 |
| 5,008,179 | 4/1991 | Chari et al. | 430/546 |
| 5,173,398 | 12/1992 | Fukazawa et al. | 430/546 |
| 5,468,600 | 11/1995 | Watanabe et al. | 430/546 |
| 5,484,692 | 1/1996 | Mitsui et al. | 430/546 |
| 5,521,058 | 5/1996 | Yoshioka et al. | 430/546 |
| 5,580,710 | 12/1996 | Takizawa et al. | 430/546 |
| 5,589,322 | 12/1996 | Lobo et al. | 430/546 |
| 5,593,816 | 1/1997 | Takizawa et al. | 430/546 |
| 5,639,590 | 6/1997 | Yoshioka | 430/546 |

FOREIGN PATENT DOCUMENTS 1193349 5/1970 United Kingdom .

OTHER PUBLICATIONS

Research Disclousure No. 16468, Dec. 1977, pp. 75–80.

*Primary Examiner*—Hoa Van Le
*Attorney, Agent, or Firm*—Andrew J. Anderson

[57] ABSTRACT

The invention is accomplished by providing an aqueous dispersion of a photographic coupler by precipitation from a solvent solution by solvent and/or pH shift. A second aqueous dispersion of an activating permanent solvent for the photographic coupler is also provided. The dispersion of activating permanent solvent and photographic coupler are combined to form a combined dispersion with relatively low amounts of coupler solvent which may be then mixed with a gelatin dispersion of silver halide particles to form a photographic emulsion coating composition suitable for casting as a photographic element layer. The coupler is selected to have a logP greater than or equal to about 10 and the activating solvent is selected to have a logP greater than or equal to about 8 and a Tg less than or equal to about −80° C. to provide stable, small size photographically active coupler dispersions without the need for nonionic water soluble polymers and with minimal amount of added solvent. Use of a weight ratio of permanent solvent to coupler within the range of from 0.01:1 to 0.3:1 in accordance with the invention enables thin photographic layers to be coated with good photographic activity.

20 Claims, 4 Drawing Sheets

HIGH ACTIVITY PHOTOGRAPHIC DISPERSIONS WITH ULTRA LOW LEVELS OF PERMANENT SOLVENT

FIELD OF THE INVENTION

The present invention concerns a method for forming stable finely dispersed particles of photographic components and incorporating such dispersions in photographic systems. It particularly relates to the preparation of stable dispersions of photographic coupler materials with low levels of permanent coupler solvent.

BACKGROUND OF THE INVENTION

The conventional "oil in water" dispersion method for incorporating hydrophobic couplers is described in U.S. Pat. No. 2,322,027 by Jelly and Vittum. The coupler is dissolved in a high boiling water immiscible solvent, mixed with aqueous gelatin, and dispersed using a colloid mill or homogenizer. The dispersion is then typically chill set and stored under refrigeration.

Frequently, the combination of coupler and solvent has to be heated to a high temperature in order to dissolve the coupler. In some instances the coupler may crystallize subsequently upon chill setting and storage of the dispersion. In designing formulations, considerable effort has to be made to select a coupler solvent so that the coupler does not crystallize. The process also suffers from the disadvantage that a large amount of energy has to be expended to generate the high shearing forces needed in milling or homogenization in order to minimize particle size. Additionally, the minimum particle sizes generally obtainable even at the highest shearing forces is usually limited to greater than 0.1 micron.

Alternative methods for delivering hydrophobic materials, such as color couplers, to photographic compositions are known in the art. U.S. Pat. No. 4,199,363 by Chen, e.g., describes latex loading as a method. The coupler is loaded into a latex polymer by mixing a solution of the coupler in a low boiling water miscible organic solvent with an aqueous suspension of the latex. The solvent is then removed by evaporation or washing, and the latex suspension is mixed with aqueous gelatin. It has been observed that coagulation of the latex may occur while loading the coupler into the latex or subsequently while mixing the loaded latex with gelatin.

U.S. Pat. No. 2,801,170 of Vittum et al discloses preparing separate dispersions of a coupler and a high boiling point solvent and mixing the two dispersions with a silver halide emulsion. U.S. Pat. No. 2,787,544 of Godowsky et al discloses a method of making mixed packet photographic systems. A dispersion of high boiling point solvent is mixed with a dispersion of coupler. While both these processes help prevent crystallization of the coupler by keeping the solvent and the coupler separate until just prior to coating, the separate dispersions are prepared by milling or homogenization and, therefore, require the use of large amounts of energy to achieve the necessary size reduction.

The art of precipitation of hydrophobic coupler for photographic systems, starting from a solution state, to fine particle colloidal dispersions is known. This is generally achieved by dissolving the coupler in a water-miscible solvent aided by addition of base to ionize the coupler, addition of a surfactant with subsequent precipitation of the couplers by lowering the pH, or by shift in concentration of the two or more miscible solvents, such that the coupler is no longer soluble in the continuous phase and precipitates as a fine colloidal dispersion. While dispersions with initial particle sizes of less than 0.1 micron may be obtained, such fine dispersions are frequently unstable, and exhibit substantial individual particle growth and/or coagulation upon storage.

United Kingdom Patent 1,193,349 of Townsley et al discloses a process whereby a color coupler is dissolved in a mixture of water-miscible organic solvent and aqueous alkali. The solution of coupler is then homogeneously mixed with an aqueous acid medium including a protective colloid. A dispersion of precipitated color coupler was formed by shift of pH, and this dispersion of color coupler, when mixed with a dispersion of an aqueous silver halide emulsion and coated on a support, was incorporated into a photographic element.

In an article in *Research Disclosure* 16468, December 1977, pages 75–80 entitled "Process for Preparing Stable Aqueous Dispersions of Certain Hydrophobic Materials" by W. J. Priest, published by Industrial Opportunities Ltd., The Old Harbormaster's, 8 North Street Emsworth, Hants P 010 7DD U.K., a method of forming stable aqueous dispersions of hydrophobic photographic material was disclosed. The method involves the formation of an alkaline aqueous solution of an alkali soluble color-forming coupler compound in the presence of a colloid stabilizer or polymeric latex. The alkali solution is then made more acidic in order to precipitate coupler. The particles of coupler are stabilized against excessive coagulation by adsorption of a colloid stabilizer.

U.S. Pat. No. 2,870,012 of Godowsky et al disclosed formation of a finely divided suspension of a coupler by precipitation caused by solvent shift. Also disclosed is utilization of a surfactant that is a dioctyl ester of sodium sulfosuccinic acid as a wetting or dispersion agent. It is indicated in Godowsky et al that the materials are stable for a long period of time after removal of the solvent.

U.S. Pat. No. 4,388,403 of Helling et al discloses the formation of dispersions of polymers that are stable for long periods of time and useful in photographic processes.

U.S. Pat. No. 4,957,857 of Chari proposed that stable dispersions of couplers be formed by a precipitation process by solvent and/or pH shift from solution in the presence of a nonionic water soluble polymer (such as polyvinylpyrrolidone) in combination with anionic surfactant having a sulfate or sulfonate head group and a hydrocarbon chain containing 8 to 20 carbons. While this technique was successful in forming stable dispersions without the use of mechanical operations such as milling or homogenization, it was found that the dispersed coupler was not always as active as in dispersions formed by the previous milling process described in U.S. Pat. No. 2,322,027 by Jelly and Vittum. Also, the use of nonionic water soluble polymer in the precipitated coupler dispersion may result in significantly thicker coated photographic layers, while it is generally desirable to minimize the dry thickness of the coated layers in the design of silver halide light-sensitive multilayer photographic materials. Layer thinning is advantageous for reasons such as improved image sharpness due to reduced light scattering during exposure and increased developability due to shorter diffusion paths through the multilayer structure. This increase in developability can lead to lower silver and/or coupler coated levels, hence lower materials cost.

U.S. Pat. No 5,008,179 of Chari et al discloses the use of an aqueous dispersion of an activating permanent solvent in combination with precipitated dispersions of photographic couplers, where the activating solvent is preferably incorporated into a dispersion of latex particles, to provide increased photographic activity and coupler dispersion stability. The addition of relatively large amounts of activating solvents and latex particles, however, can also result in significantly thicker coated photographic layers, which is disadvantageous as discussed above.

In order to reduce the coated thickness of photographic layers, it is essential to minimize the amount of permanent coupler solvent coated in the element. In fact, reductions in coupler solvent level also afford concomitant reductions in gelatin level which leads to further reductions in coated dry thickness. U.S. Pat. No. 5,173,398, e.g., discloses photographic elements with coupler-containing layers having substantially no high-boiling solvent, wherein the couplers are incorporated in the layer in the form of precipitated dispersions. However, coupler solvent reduction can also result in reducing the reactivity of the dispersed photographically useful chemical, such as a dye-forming coupler, to a level too low to produce desired dye density upon processing of the photographic material.

It would be desirable to obtain active, stable precipitated coupler dispersions in the absence of significant amounts of added permanent solvent, water soluble polymers, and/or polymer latexes, or with minimal addition of such materials. It would be further desirable to provide silver halide photographic elements made from such dispersions, which achieve high coupler reactivity in the photographic material to obtain adequate dye density upon processing. It is further desirable to achieve a reduction in the coated level of coupler solvent in photographic elements to decrease coated dry thickness. It is toward these ends that the present invention is directed.

SUMMARY OF THE INVENTION

An object of the invention is to overcome difficulties with the prior processes of forming dispersions of photographic materials.

A further object is to provide precipitated coupler dispersions of improved photographic activity.

Another object of the invention is to provide a method of forming dispersions of photographic coupler materials that are stable during storage without refrigeration.

Another object of the invention is to provide a method of forming precipitated dispersions of photographic coupler materials that are stable during storage even in the absence of nonionic water soluble polymers such as polyvinylpyrrolidone.

A further object of the invention is to provide a method of forming photographic materials with thin emulsion layers.

A further object of the invention is to provide dispersions of photographic coupler materials without the use of mechanical operations, such as milling or homogenization.

These and other objects are accomplished in accordance with one embodiment of the invention which comprises a method of forming a photographic dispersion comprising: providing an aqueous dispersion of photographic coupler having a logP of greater than or equal to about 10 by precipitation from an auxiliary solvent solution by pH or solvent shift; providing an aqueous dispersion of activating permanent solvent having a logP of greater than or equal to about 8 and a glass transition temperature of less than or equal to about −80° C.; and combining said dispersion of photographic coupler and said dispersion of activating permanent solvent to form a combined dispersion with a weight ratio of permanent solvent to coupler within the range of from 0.01:1 to 0.3:1. The combined dispersion may then be mixed with silver halide emulsion to form a photographic emulsion layer coating composition.

DETAILED DESCRIPTION

The invention has numerous advantages over prior processes. The invention allows the formation of stable coupler dispersions that can be kept without refrigeration. The invention provides dispersions formed by pH or solvent shift having photographic activity comparable to that of milled dispersions of couplers. The invention provides dispersions without the use of mechanical operations, such as milling or homogenization. These and other advantages will be apparent from the description below.

Figure 1:
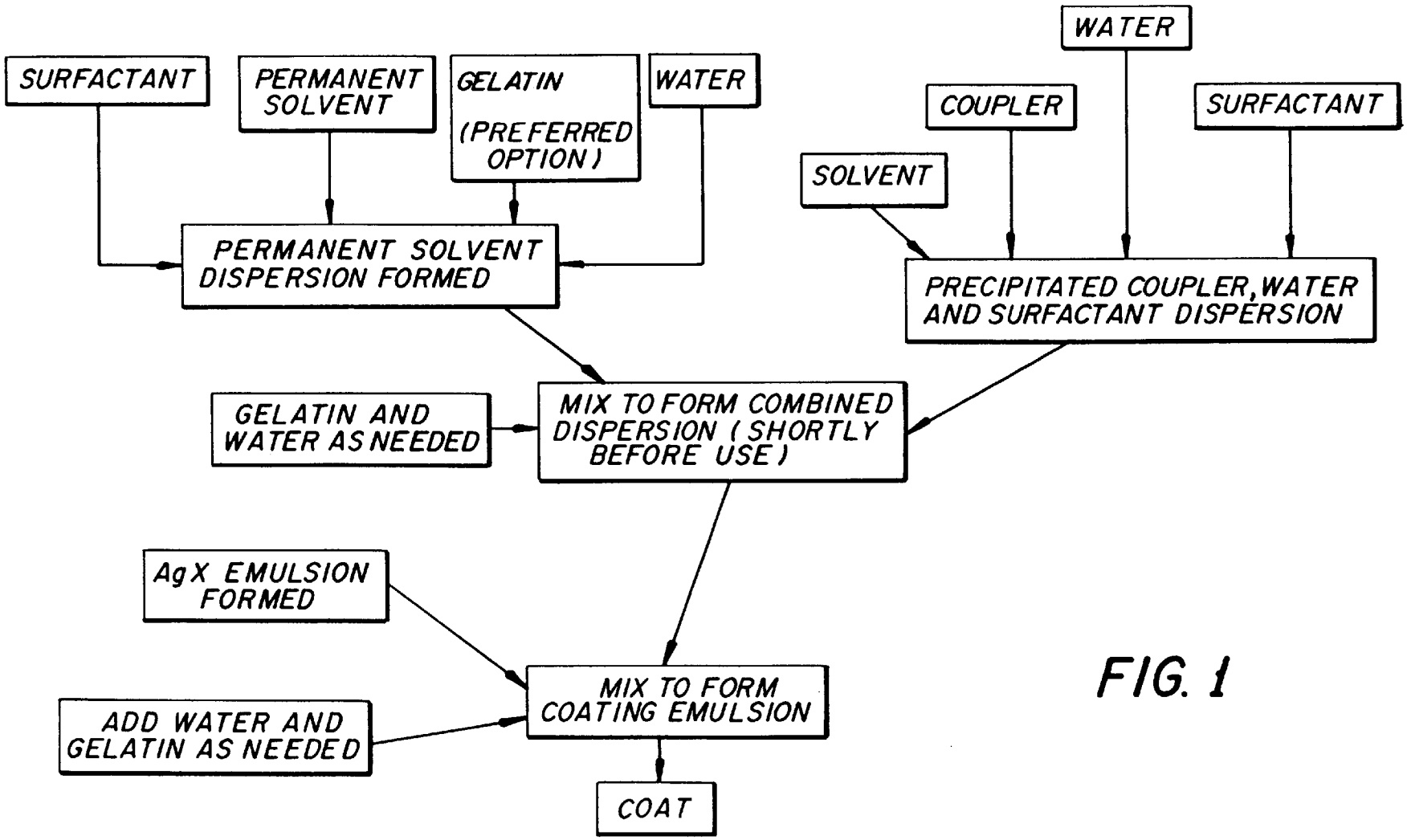
FIG. 1 is a flow sheet illustrating the steps of the invention processes.

Processes in accordance with the invention are generally as described in U.S. Pat. No. 5,008,179 referenced above, the disclosure of which is incorporated by reference herein in its entirety. The process in accordance with one preferred embodiment of the invention is generally as illustrated in FIG. 1. As illustrated there, permanent solvent and water are combined to form a dispersion of the permanent solvent in water. An auxiliary solvent may also be present to facilitate formation of the dispersion, and may be subsequently removed by evaporation or washing. There may also be surfactants, hydrophilic colloids such as gelatin, and additional polymers present. In contrast to the disclosure of U.S. Pat. No. 5,008,179, however, in a preferred embodiment of the instant invention no polymer latex is present. The permanent water immiscible solvent is a solvent for the coupler.

A second dispersion of coupler, water, and surfactant is prepared by dissolving the coupler in an auxiliary solvent and surfactant, precipitating the coupler by addition of water and/or change of pH to form the dispersion, and then washing to remove the auxiliary solvent. These two dispersions, one containing the permanent water immiscible solvent and the other the coupler particles, are mixed to provide a permanent solvent to coupler weight ratio from 0.01:1 to 0.3:1, preferably from 0.01:1 to 0.2:1, and more preferably from 0.05:1 to 0.15:1. Permanent solvent to coupler weight ratios of at least 0.01:1, and more preferably at least 0.05:1 are desired to provide sufficient coupler activation. Permanent solvent to coupler weight ratios of less than 0.3:1, preferably less than 0.2:1 and most preferably less than 0.15:1 are desired to minimize levels of coated materials in order to enable thin layers to be achieved.

The coupler dispersion and activating solvent dispersion are preferably combined shortly before use. They may then be combined with a silver halide emulsion formed by any conventional means and then, after addition of water and gelatin as needed to form the proper coating emulsion, are coated to form a photographic element. As the permanent solvent and coupler preferably do not come into contact until immediately prior to use, difficulties with crystallization of the coupler during storage are eliminated. Use of couplers and solvents with the indicated logP and Tg values enables active coupler dispersions to be obtained with use of only minimal amounts of added coupler solvent and stable dispersions with no added polymer.

Dispersions of permanent solvent are typically prepared by optionally mixing the permanent solvent with a water miscible or low boiling auxiliary solvent such as ethyl acetate and then mixing the solvent(s) with an aqueous hydrophilic colloid solution in the presence of surface active agents. Auxiliary solvent(s) are then typically removed by evaporation or washing if present. The aqueous phase of the solvent dispersions of the invention preferably comprise gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water-soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The precipitated dispersions of coupler are generally formed by combining the coupler with a solvent, such as propanol, and heating and stirring until the coupler is dissolved. To the dissolved coupler is typically added additional water, surfactant, and an acid to lower the pH to form particles. The solvent may have a base such as sodium hydroxide added to aid in dissolving of the coupler. The dispersion after pH and solvent shift is then washed to remove the solvent. The washed coupler dispersion is storage stable without refrigeration. The separate dispersions of permanent water immiscible solvent and precipitated coupler are preferably mixed shortly prior to use. After the coupler dispersion and permanent solvent dispersion have been mixed together, the combined dispersion is then mixed with a silver halide emulsion and other materials as needed in forming a coating composition for photographic film layers. U.S. Pat. No. 4,957,857 of Chari is referred to for detailed disclosure of formation of coupler dispersions, the disclosure of which is incorporated herein by reference.

The couplers suitable for this invention may be any couplers that may be precipitated by solvent and/or pH shift and which have a logP of greater than or equal to about 10, more preferably greater than or equal to about 12. The log P parameter is a well-known measurement of the solubility of a compound in aqueous liquids compared to its solubility in a nonpolar organic solvent (octanol). The log P parameter is further described, along with data for organic compounds, in C. Hansch & T. Fujita, J. Am. Chem. Soc., 86, 1616–25 (1964) and A. Leo & C. Hansch, *Substituent Constants for Correlation Analysis in Chemistry and Biology*, Wiley, New York (1979), the disclosures of which are incorporated herein by reference. If the log P of the precipitated is below about 10, the dispersion may not exhibit sufficient particle size stability upon storage.

Couplers having a high log P in accordance with the invention may be so highly hydrophobic that it is difficult to measure their water solubility using standard techniques. Such compounds preferably have a solubility in water of less than 1.0 $\mu$g/mL. In such cases, $LogP_{(calc)}$ is a useful means to characterize their hydrophobicity, where $LogP_{(calc)}$ is the logarithm of the value of the octanol/water partition coefficient (P) of the compound calculated using MedChem, version 3.54, a software package available from the Medicinal Chemistry Project, Pomona College, Claremont, Calif. $LogP_{(calc)}$ is a parameter which is highly correlated with measured water solubility for compounds spanning a wide range of hydrophobicity.

Exemplary couplers which may be used in accordance with the invention include the following:

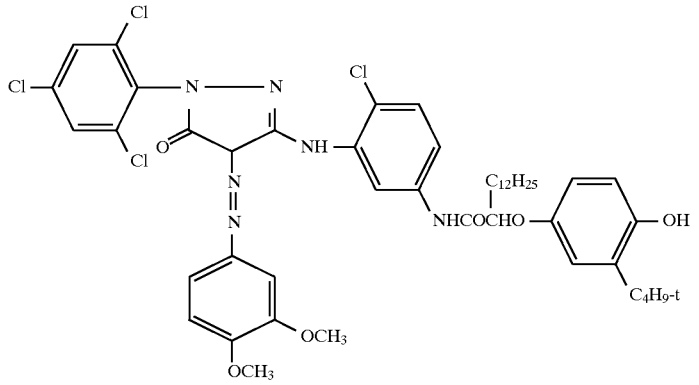

C1 (LogP(calc) 13.0)

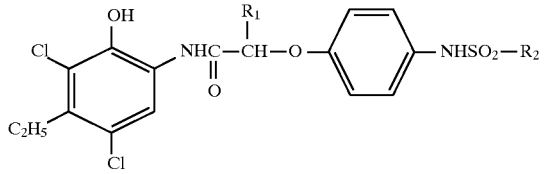

| Coupler | $R_1$ | $R_2$ | LogP(calc) |
|---|---|---|---|
| C2 | $C_{16}H_{33}$ | $CH_3$ | 12.0 |

-continued
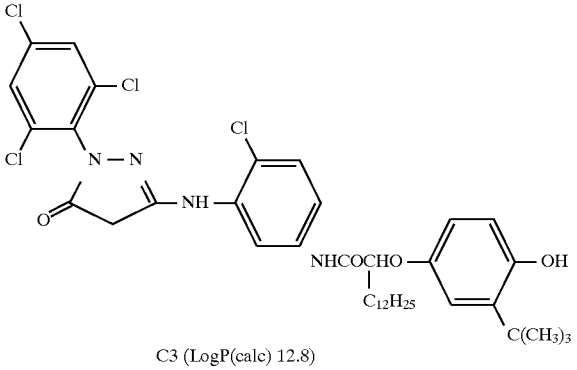
C3 (LogP(calc) 12.8)
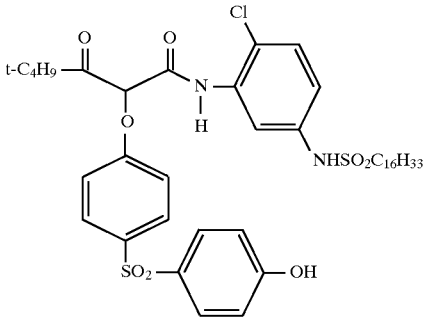
C4 (LogP(calc)11.3)
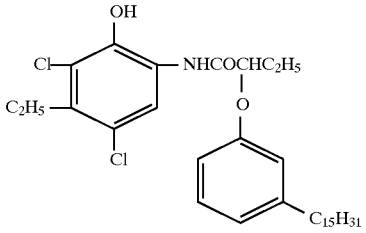
C5 (LogP(calc)13.9)
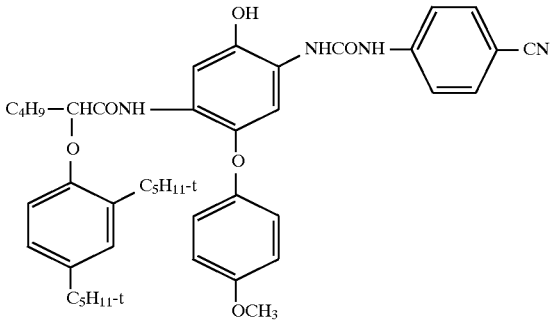
C6 (LogP(calc)11.6)
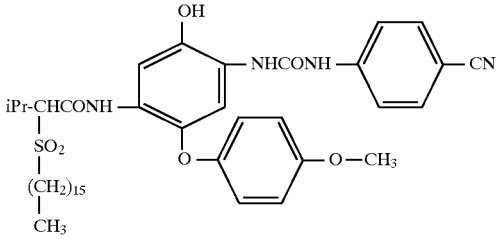
C7 (LogP(calc)11.3)

-continued

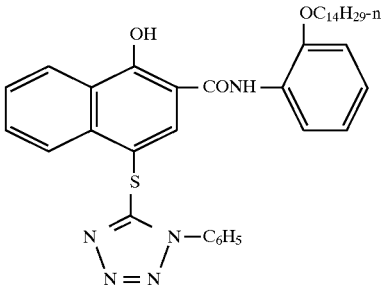

C8 (LogP(calc)12.1)

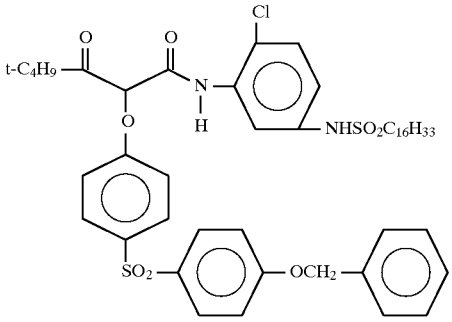

C9 (LogP(calc)13.3)

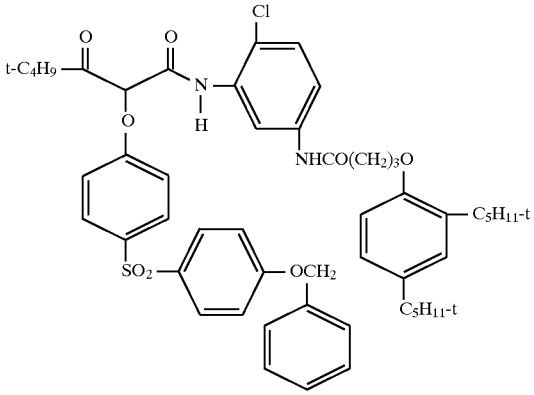

C10 (LogP(calc)12.5)

The permanent activating solvents may be any water immiscible solvent having a logP of greater than or equal to about 8, preferably greater than or equal to about 9, and a glass transition temperature ($T_g$) of less than or equal to about −80° C., preferably less than or equal to about −90° C., more preferably less than or equal to about −100° C. If the logP of the permanent solvent is less than about 8, it may not be sufficiently compatible with the high logP couplers utilized. If the Tg is greater than −80° C., sufficient coupler activity may not be achieved at low levels of activating permanent solvent to coupler within the range of from 0.01:1 to 0.3:1 required by the invention to enable thin photographic element emulsion layers. Preferred activating permanent solvents for use in accordance with the invention include trialkylphosphates where the alkyl groups are branched alkyl groups comprising at least 6 carbon atoms. A particularly preferred permanent solvent comprises tri-2-ethylhexylphosphate.

The water miscible auxiliary solvent for dissolving the hydrophobic coupler may be any solvent capable of dissolving the coupler without decomposing the coupler. Suitable solvents include methanol, propanol, isopropyl alcohol, and butyl alcohol.

Preferred surfactants for use in forming the dispersions of the invention are any anionic surfactant having a sulfate or sulfonate head group. The head group is the group on the surfactant that extends away from the particle into the water in which the particles disperse. The other portion of the surfactant is a hydrophobic group of, e.g., 8 to 20 carbons that will lie on the surface of the coupler particle. The sulfate or sulfonate group may be represented as an $SO_3M$ or $OSO_3M$ moiety where M represents a cation. M most commonly is sodium. Particularly preferred surfactants which are employed in the present invention include an alkali metal salt of an alkarylene sulfonic acid, such as the sodium salt of dodecyl benzene sulfonic acid or sodium salts of isopropylnaphthalene sulfonic acids, such as mixtures of di-isopropyl- and tri-isopropylnaphthalene sodium sulfonates; an alkali metal salt of an alkyl sulfuric acid, such as sodium dodecyl sulfate; or an alkali metal salt of an alkyl sulfosuccinate, such as sodium bis (2-ethylhexyl) succinic sulfonate. Typical of surfactants suitable for use in forming the dispersions of the invention are those as follows:

$C_{12}H_{25}OSO_3Na$ A-1

$C_{14}H_{29}OSO_3Na$ A-2

$C_{12}H_{25}CONHCH_2CH_2OSO_3Na$ A-3

$C_{12}H_{25}SO_3Na$ A-4

$C_{14}H_{29}SO_3Na$ A-5

$NaO_3S-CH(CH_2COOC_8H_{17})-COOC_8H_{17}$ A-6

A-7

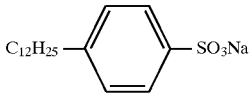

A-8

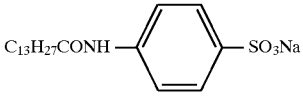

A-9

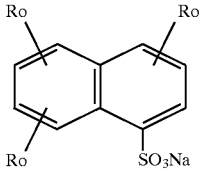

Ro represents $-CH(CH_3)_2$

A-10

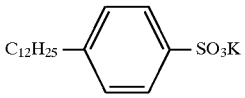

A-11

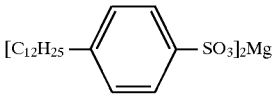

The surfactants below are preferred as they form uniform storage stable dispersions:

A-12 A mixture of di-isopropyl and tri-isopropyl naphthalene sodium sulfonate. The ratio of the di-isopropyl to the tri-isopropyl compound is between about 0.25 and about 2.0.

A-13

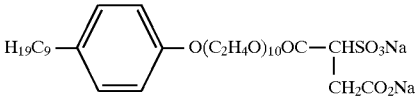

A-14

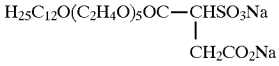

-continued

A-15

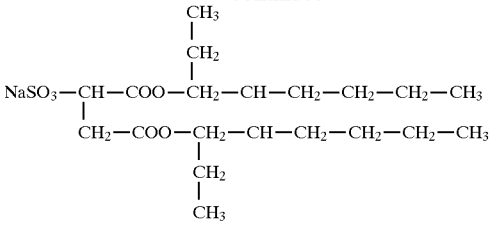

Photographic elements comprising coupler dispersions in accordance with the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, subbing layers, and the like.

If desired, the photographic element can be used in conjunction with an applied magnetic layer as described in *Research Disclosure*, November 1992, Item 34390. It is also specifically contemplated to use dispersions according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

In the following discussion of suitable materials for use in the emulsions and elements that can be used in conjunction with this photographic element, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described , for example, in Sections VI–IX. Layers and layer arrangements, color negative and color positive features, scan facilitating features, supports, exposure and processing can be found in Sections XI–XX.

Couplers that form cyan dyes upon reaction with oxidized color developing agents which can be incorporated in elements of the invention are described in such representative patents and publications as: U.S. Pat. Nos. 2,367,531; 2,423,730; 2,474,293; 2,772,162; 2,895,826; 3,002,836; 3,034,892; 3,041,236; 4,333,999; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Preferred couplers include 1H-pyrazolo [5,1-c]-1,2,4-triazoles and 1H-pyrazolo [1,5-b]-1,2,4-triazoles. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659,652; 5,066,575; and 5,250,400. Especially preferred are pyrazolone couplers, such as described in U.S. Pat. No. 4,853,319.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928; 4,022,620; 4,443,536 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted.

It may be useful to use a combination of couplers any of which may contain known ballasts or coupling-off groups such as those described in U.S. Pat. Nos. 4,301,235; 4,853,319 and 4,351,897.

It is also contemplated that the materials and processes described in an article titled "Typical and Preferred Color Paper, Color Negative, and Color Reversal Photographic Elements and Processing," published in *Research Disclosure*, February 1995, Volume 370 may also be advantageously used with the dispersions of the invention.

The invention materials may further be used in combination with a photographic element containing image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613. Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference.

Especially useful for use with this invention are tabular grain silver halide emulsions. Suitable tabular grain emulsions can be selected from among a variety of conventional teachings, such as those of the following: Research Disclosure, Item 22534, January 1983; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069; 5,061,616; and 5,320,938.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Specifically contemplated and preferred are Se and Ir doped tabular emulsions as described in U.S. Pat. No. 5,164,292. Usage of the invention in combination with thin layers as described in U.S. Pat. No. 5,322,766 is also specifically contemplated and preferred.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904, 5,292,634, 5,354,651, and 5,492,802, in conjunction with elements of the invention.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

The following examples are given to illustrate the invention in greater detail. Unless otherwise specified, all percentages and ratios are based on weight.

EXAMPLE 1

This example illustrates the effect of a lower Tg permanent coupler solvent or plasticizer on the glass transition temperature of the dispersed phase in a precipitated dispersion of the coupler C1.

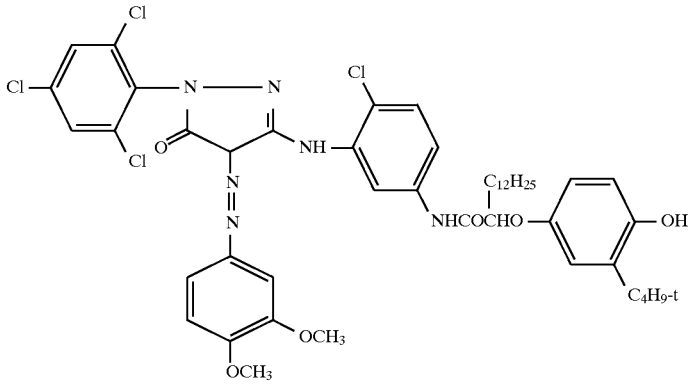

C1

A precipitated dispersion of the coupler C1 was made in the following manner. Four grams of C1 was mixed with 10 grams of n-propanol and heated to 60° C. Then 1.3 grams of a 20% solution of sodium hydroxide was added and the mixture was stirred until the coupler dissolved. A surfactant solution containing 3.8 grams of 30% w/w Aerosol A102 in 100 grams of water was then added to the dissolved coupler at room temperature. A solution of acetic acid was added to lower the pH to 6. The dispersion was then washed with distilled water for 4 hours using a dialysis membrane tubing.

The above precipitated dispersion of C1 was then combined with different amounts of a dispersion of the permanent solvent tricresyl phosphate and the glass transition temperature (Tg) of the dispersed phase was determined by Differential Scanning Colorimetry (DSC). The heating rate was 10° C./min and the Tg was taken as the temperature at which the specific heat reached a value that was midway between those corresponding to the glassy and fluid states.

Figure 2:
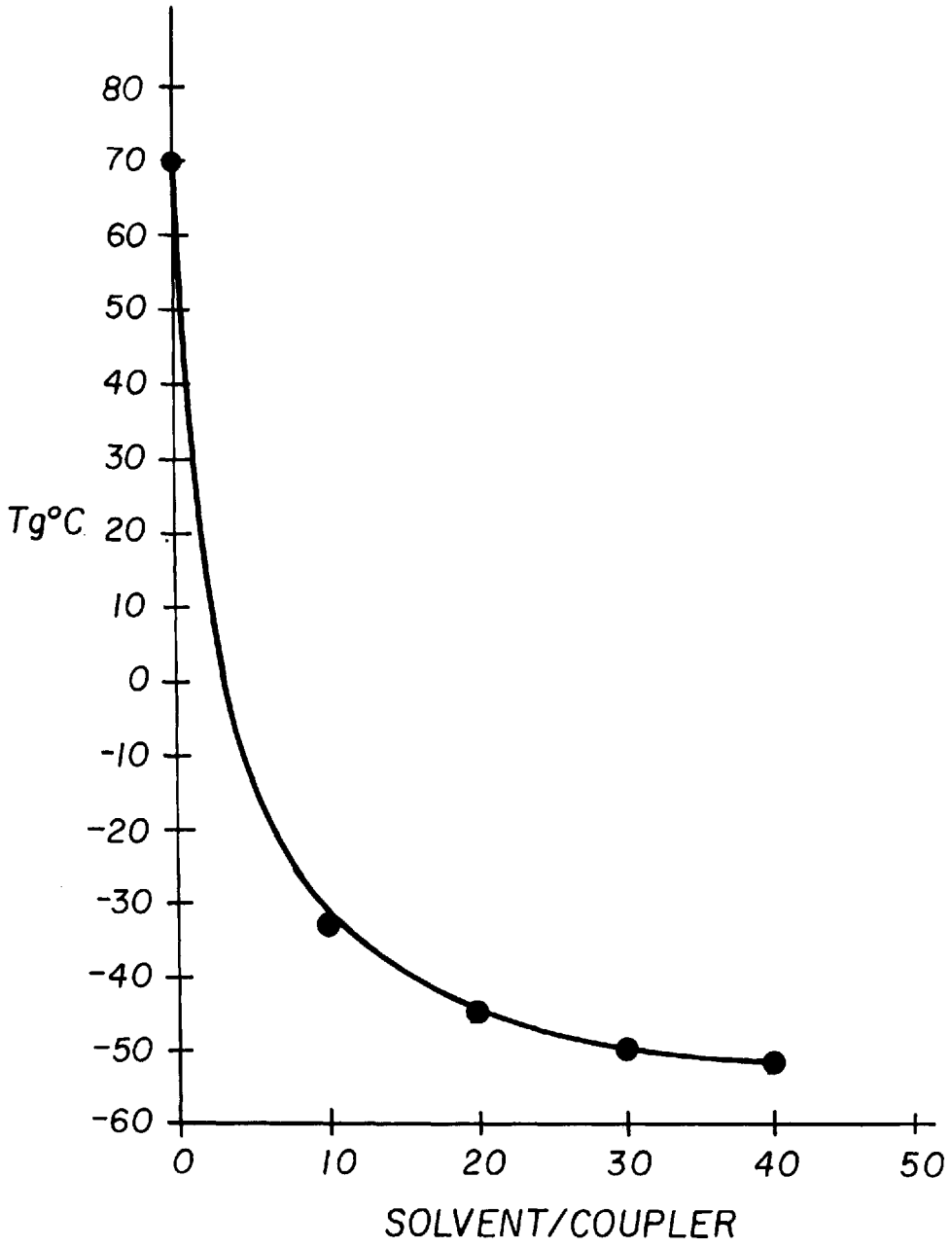
FIG. 2 is a graph of glass transition temperature, Tg, versus solvent/coupler ratio for dispersions of precipitated coupler and permanent coupler solvent for Example 1.

FIG. 2 shows the glass transition temperature of the dispersed phase as a function of the permanent solvent to coupler ratio. It is clear that as we increase the proportion of permanent solvent, the Tg of the dispersed phase drops from the Tg of the pure coupler (about 71° C.) and approaches the Tg of the pure permanent solvent (about −59° C.) whe n the proportion of permanent solvent to coupler is high. The Tg is a measure of the mobility and flexibility of the molecules. The lower the Tg, the higher the mobility and flexibility.

EXAMPLE 2

This example illustrates the effect of the calculated logP (logarithm of the octanol/water partition coefficient) of the coupler on particle size in a precipitated dispersion.

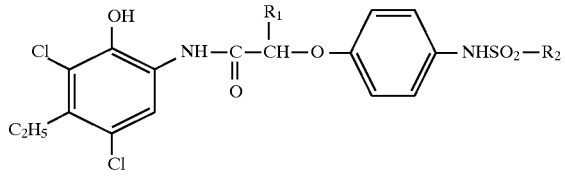

| Coupler | $R_1$ | $R_2$ | $LogP_{(calc)}$ |
|---|---|---|---|
| C2 | $C_{16}H_{33}$ | $CH_3$ | 12.0 |
| CC1 (comparison) | $C_{10}H_{21}$ | $CH_3$ | 8.9 |

Precipitated dispersions of the couplers C2 and CC1 were made in the following manner. 0.5 grams of coupler was combined with 1.25 mL of n-propanol and 0.8 mL of 1M sodium hydroxide solution. A solution of sodium dodecyl sulfate (SDS) containing 0.1 grams of surfactant in water was prepared. The amount of water was adjusted to give a concentration of 2.3% coupler in the final dispersions. The surfactant solution was added to the solution of the coupler in propanol and sodium hydroxide and the pH was reduced to 6.0 using dilute acetic acid. The dispersions were then washed for 2 hours to remove propanol.

The particle size in these dispersions was determined by Cryotransfer transmission electron microscopy (cryo-TEM). In the dispersion of C2, the majority of particles were less than 20 nm in size whereas the dispersion of CC1 contained a number of particles having dimensions close to 100 nm.

EXAMPLE 3

This example also illustrates the effect of logP of the coupler on particle size in a precipitated dispersion.

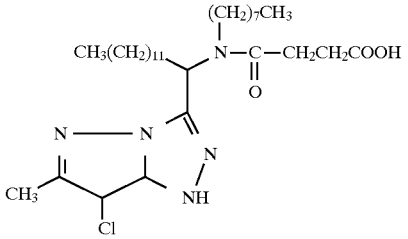

CC2 LogP(calc)9.7

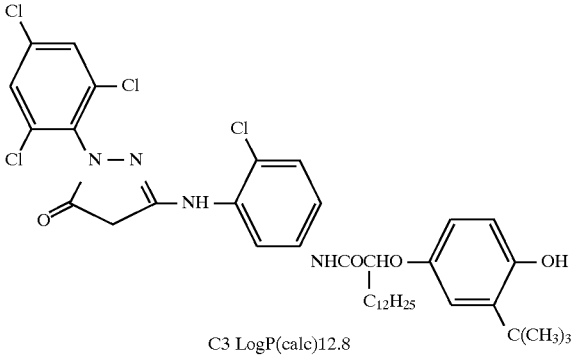

C3 LogP(calc)12.8

Dispersions of these couplers were prepared in the exact same manner as described under Example 2 except that the amount of water in the surfactant solution was adjusted to give a concentration of 3% coupler. The average particle size in the dispersions was determined by Photon Correlation Spectroscopy(PCS).

| Coupler | Average particles size in dispersion (nm) |
|---|---|
| CC2 | 169 |
| C3 | 13 |

Once again it is clear that the coupler having higher logP gives a dispersion with significantly lower particle size.

EXAMPLE 4

This example compares the photographic activity of a precipitated dispersion of a high logP coupler with a dispersion of the same coupler prepared by standard homogenization techniques.

A precipitated dispersion of C1 (LogP(calc) 13.0) was prepared in the following manner. 43.2 grams of C1 was dissolved in 90 mL of n-propanol. 60 mL of 1 M sodium hydroxide solution was then added and the solution cooled to room temperature. A solution of surfactant was prepared by combining 4.4 grams of SDS with 1000.32 mL of water. The surfactant solution was added to the solution of the coupler in propanol and sodium hydroxide and the pH adjusted to 6.0 using 15% w/w acetic acid. The resulting dispersion was placed in a Spectra/Por dialysis membrane tubing (12,000–14,000 molecular weight cutoff) and washed for two hours. Examination of the dispersion by Cryo-TEM showed that the majority of particles were 20 nm or less in size.

A dispersion of C1 by homogenization was prepared in the following manner. The aqueous phase was prepared by combining 24 grams of a 12.5% solution of Type IV gelatin with 2.5 grams of Alkanol XC and 21.5 grams of water. The oil phase was prepared by dissolving 2 grams of C1 in about 5 mL of ethyl acetate. The aqueous phase was then added to the oil phase and the mixture was passed three times through a colloid mill. The ethyl acetate was then removed by evaporation.

Figure 3:
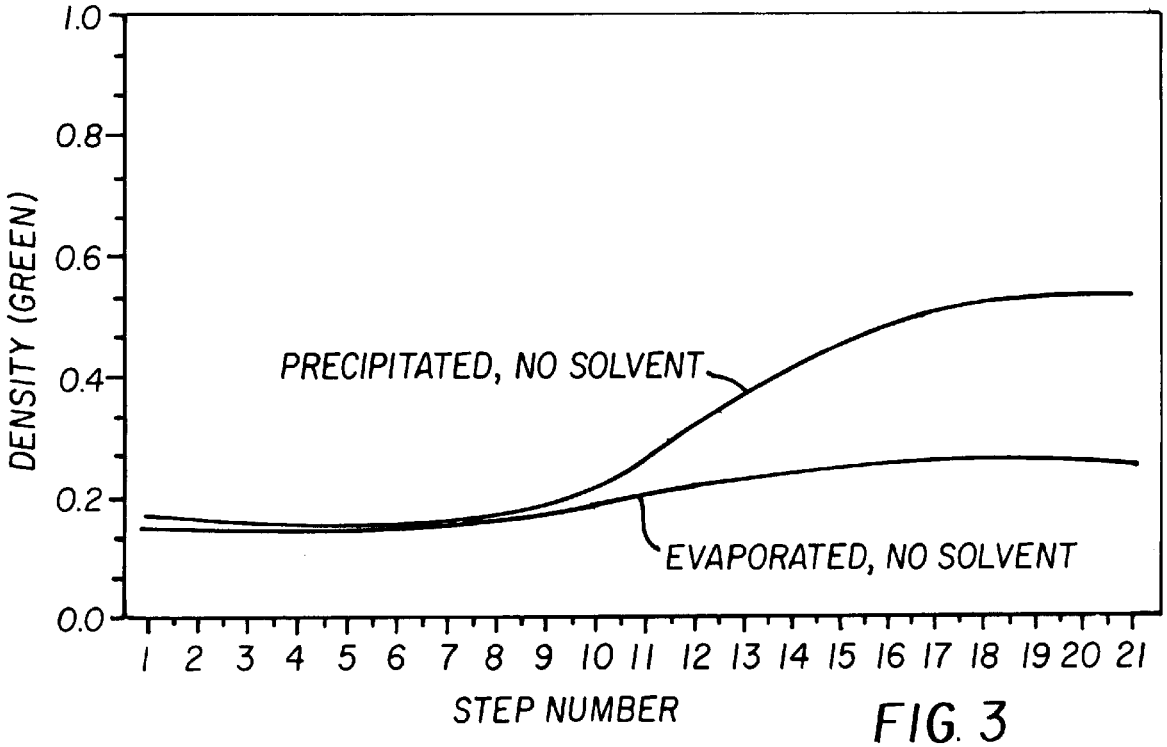
FIGS. 3–6 illustrate sensitometric data of Examples 4 and 5.

The dispersions were then mixed with photographic emulsion and coated on a film support at a laydown of 323 mg/m$^2$ (30 mg/ft$^2$) coupler and 807 mg/m$^2$ (75 mg/ft$^2$) Ag. The coatings were exposed using a standard step tablet and processed by the C41 process with a development time of one minute and seven seconds. The status M green density was then measured as a function of exposure. The results are shown in FIG. 3. It is clear that the precipitated dispersion of the high logP coupler displays significantly greater activity relative to a standard homogenized dispersion of the same coupler prepared in the absence of permanent solvent.

EXAMPLE 5

This example shows the effect of a small amount of a relatively low Tg and high logP permanent solvent on the photographic activity of a precipitated dispersion of a high logP coupler.

Precipitated and evaporated (homogenized) dispersions of C1 were prepared in the same manner as described under Example 4. Dispersions of permanent solvents P1 and P2 were prepared in the following manner. The aqueous phase was prepared by combining 30 grams of a 12.5% solution of Type IV gelatin with 2.4 grams of Triton X 200E, 0.6 grams of a 10% solution of Olin 10G and 16.2 grams of water. The aqueous phase was heated to 45° C. and combined with 10.8 grams of permanent solvent which was also heated to 45° C. The mixture was then passed three times through a colloid mill.

Shown below are structures, logP and Tg values of permanent solvents P1 and P2.

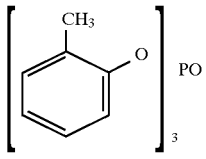

P1

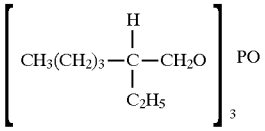

P2

| Permanent solvent | Tg | LogP$_{(calc)}$ |
|---|---|---|
| P1 | −59° C. | 6.6 |
| P2 | −109° C. | 9.5 |

Figure 4:
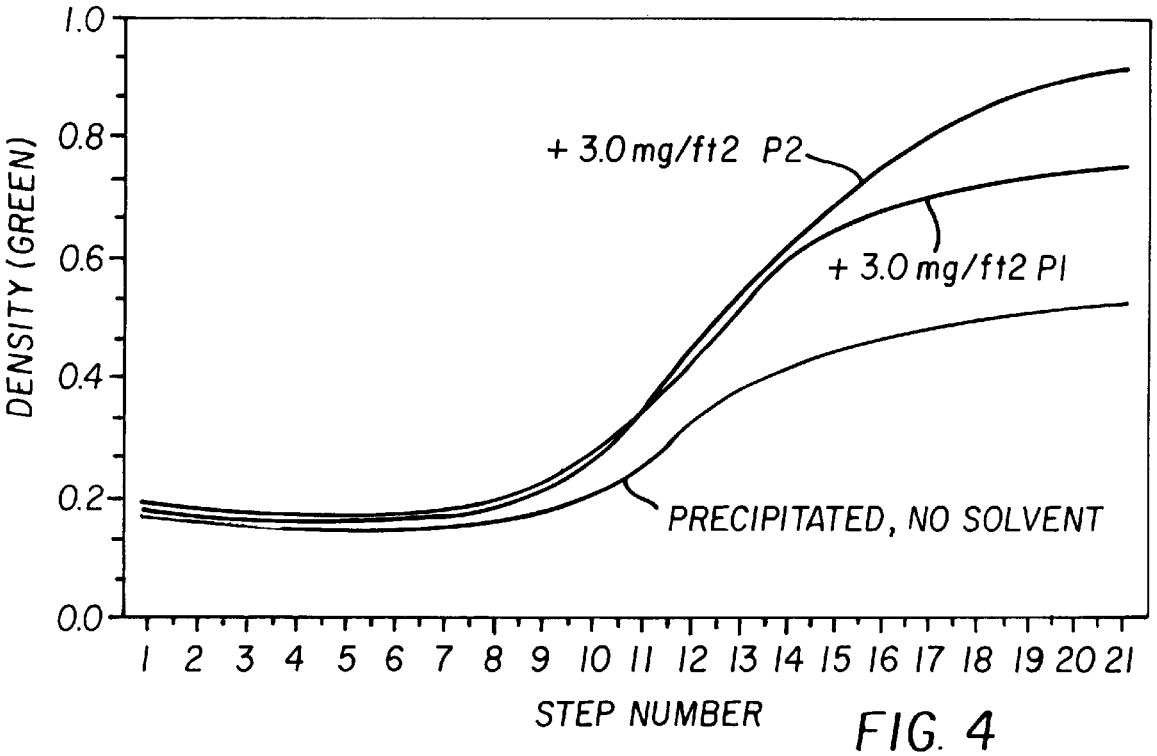
Figure 5:
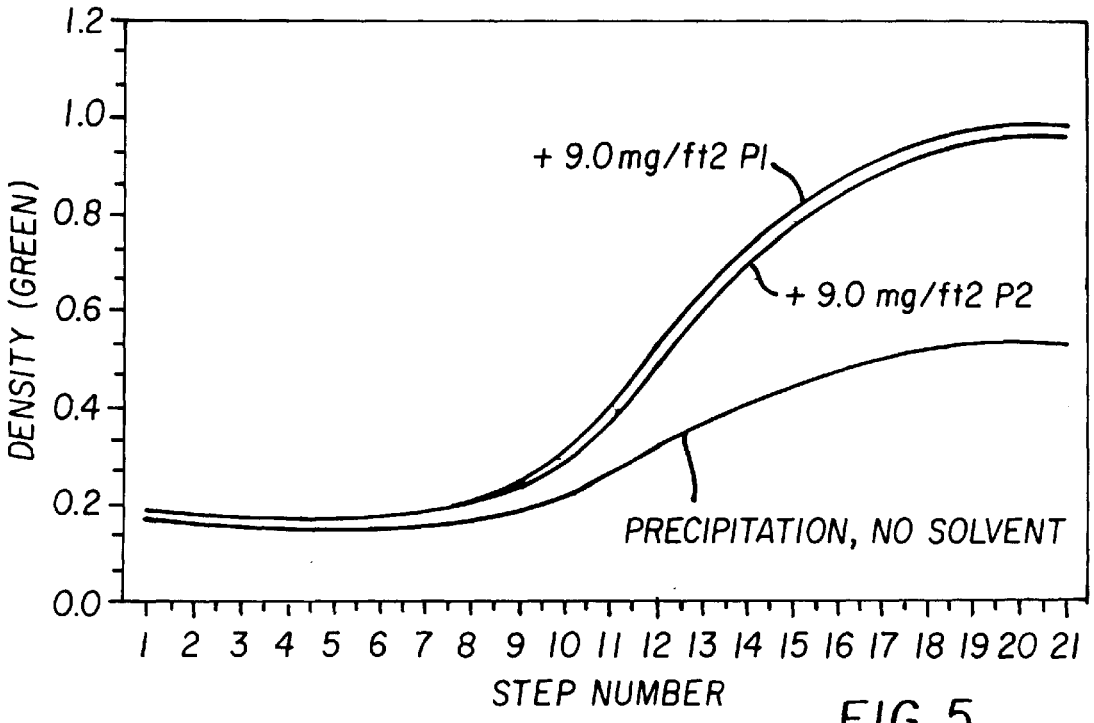

Coatings were prepared with the precipitated dispersion of C1 at 323 mg/m$^2$ (30 mg/ft$^2$) and 0, 32.3 or 96.9 mg/m$^2$ (0, 3.0 or 9.0 mg/ft$^2$) of the permanent solvents P1 and P2. The coatings were exposed and processed as described in Example 4. The results are shown in FIGS. 4 and 5. It is clear from FIG. 4 that a significantly greater increase in activity is obtained at low levels of permanent solvent (0.1:1 by weight with respect to coupler) if one uses a permanent solvent having lower Tg and higher logP. FIG. 5 shows that the advantage is not seen if higher levels of permanent solvent are used.

Figure 6:
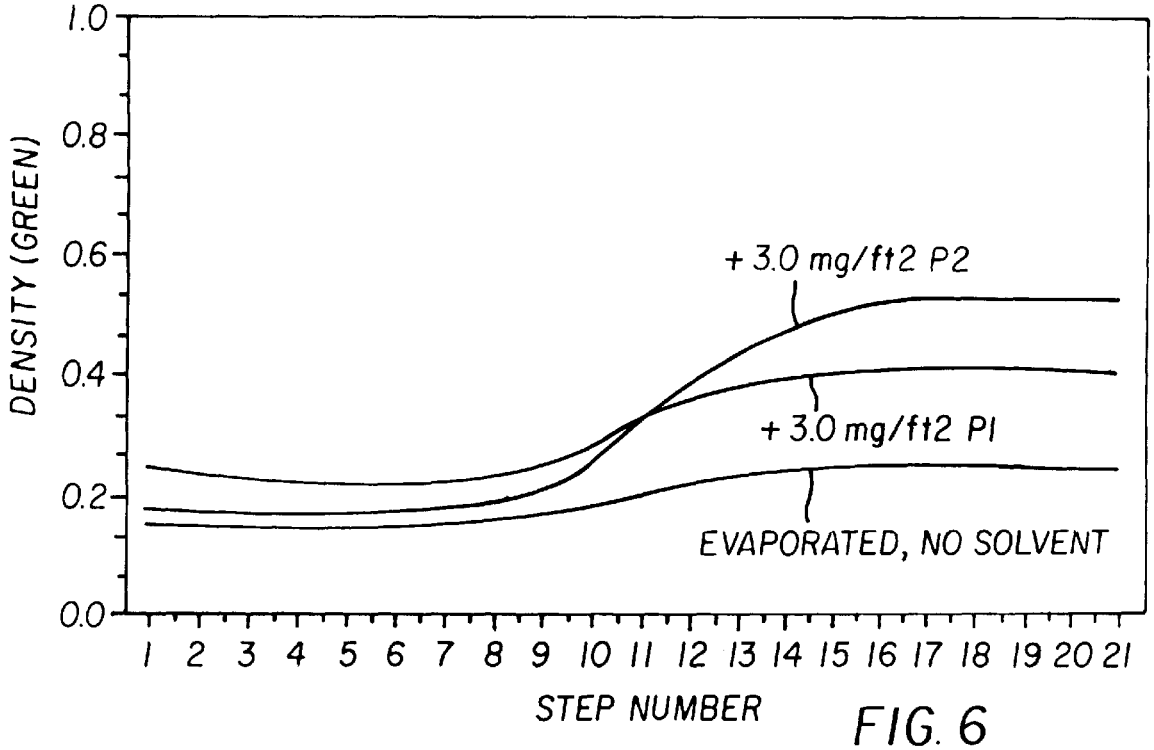

Coatings were similarly prepared with the standard homogenized dispersion of C1 at 323 mg/m$^2$ (30 mg/ft$^2$) and 0 or 32.3 mg/m$^2$ (0 or 3.0 mg/ft$^2$) of the permanent solvents P1 and P2. The coatings were exposed and processed as described in Example 4. The results are shown in FIG. 6. It is clear from FIG. 6 that the same level of activity is not obtained as using the invention combination of precipitated dispersion and a permanent solvent of low Tg and high logP.

I claim:

1. A method of forming a photographic dispersion comprising:

providing an aqueous dispersion of photographic coupler having a logP of greater than or equal to about 10 by precipitation from an auxiliary solvent solution by pH or solvent shift;

providing an aqueous dispersion of activating permanent solvent having a logP of greater than or equal to about 8 and a glass transition temperature of less than or equal to about −80° C.; and combining said dispersion of photographic coupler and said dispersion of activating permanent solvent to form a combined dispersion with a weight ratio of permanent solvent to coupler within the range of from 0.01:1 to 0.3:1.

2. The method of claim 1 further comprising mixing said combined dispersion with silver halide emulsion to form a photographic coating composition.

3. The method of claim 2, wherein the weight ratio of total permanent solvent to coupler in the coating composition is within the range of from 0.01:1 to 0.3:1.

4. The method of claim 2, wherein the weight ratio of total permanent solvent to coupler in the coating composition is within the range of from 0.01:1 to 0.2:1.

5. The method of claim 2, wherein the weight ratio of total permanent solvent to coupler in the coating composition is within the range of from 0.05:1 to 0.15:1.

6. The method of claim 2 wherein said dispersion of permanent solvent and said dispersion of photographic coupler are combined immediately prior to forming the coating composition.

7. The method of claim 1 wherein said dispersion of photographic coupler and said dispersion of activating permanent solvent are combined to form a dispersion with a weight ratio of permanent solvent to coupler within the range of from 0.01:1 to 0.2:1.

8. The method of claim 1 wherein said dispersion of photographic coupler and said dispersion of activating permanent solvent are combined to form a dispersion with a weight ratio of permanent solvent to coupler within the range of from 0.05:1 to 0.15:1.

9. The method of claim 1 wherein said permanent solvent comprise a trialkylphosphate where the alkyl group is a branched alkyl group comprising at least 6 carbon atoms.

10. The method of claim 9 wherein said permanent solvent comprises tri-2-ethylhexylphosphate.

11. The method of claim 1 wherein said photographic coupler has a logP of greater than or equal to about 12.

12. The method of claim 1 wherein said activating permanent solvent has a logP of greater than or equal to about 9.

13. The method of claim 1 wherein said activating permanent solvent has a glass transition temperature of less than or equal to about −90° C.

14. The method of claim 1 wherein said activating permanent solvent has a glass transition temperature of less than or equal to about −100° C.

15. The method of claim 1 wherein said dispersion of activating permanent solvent further comprises gelatin.

16. The method of claim 1 wherein said photographic coupler has a logP of greater than or equal to 12, said activating permanent solvent has a logP of greater than or equal to 9 and a glass transition temperature of less than or equal to −100° C., and said dispersion of photographic coupler and said dispersion of activating permanent solvent form a combined dispersion with a weight ratio of permanent solvent to coupler within the range of from 0.05:1 to 0.15:1.

17. A method of forming a photographic element comprising:

providing an aqueous dispersion of photographic coupler having a logP of greater than or by precipitation from an auxiliary solvent solution by pH or solvent shift;

providing an aqueous dispersion of activating permanent solvent having a logP of greater than or equal to 8 and a glass transition temperature of less than or equal to −80° C.;

combining said dispersion of photographic coupler and said dispersion of permanent solvent to form a combined dispersion;

mixing said combined dispersion with silver halide emulsion; and coating the mixture of said combined dispersion and said silver halide emulsion on a substrate to form a layer with a weight ratio of permanent solvent to coupler within the range of from 0.01:1 to 0.3:1.

18. The method of claim 17, wherein the weight ratio of total permanent solvent to coupler in the layer is within the range of from 0.05:1 to 0.15:1.

19. The method of claim 17 wherein said photographic coupler has a logP of greater than or equal to 12.

20. The method of claim 17 wherein said activating permanent solvent has a glass transition temperature of less than or equal to −100° C.

* * * * *